United States Patent [19]

Schaefer

[11] Patent Number: 4,762,510

[45] Date of Patent: Aug. 9, 1988

[54] SHOCKPROOF FUSEHOLDER

[75] Inventor: Rudolf K. Schaefer, Des Plaines, Ill.

[73] Assignee: Littelfuse, Inc., Des Plaines, Ill.

[21] Appl. No.: 32,713

[22] Filed: Apr. 6, 1987

Related U.S. Application Data

[63] Continuation-in-part of Ser. No. 926,611, Nov. 12, 1986.

[51] Int. Cl.[4] ..... H01R 13/213; H01R 13/68

[52] U.S. Cl. ..... 439/621; 337/195; 439/672

[58] Field of Search ..... 337/195, 198, 201, 213; 439/621, 622, 620, 670–673

[56] References Cited

U.S. PATENT DOCUMENTS

| | | | |
|---|---|---|---|
| 1,493,988 | 5/1924 | Kerwin | 439/672 |
| 1,602,227 | 10/1926 | Hentschel | 337/195 |
| 3,286,061 | 11/1966 | Henderson | 337/195 |
| 4,072,385 | 2/1978 | Wallner | 439/335 |
| 4,477,139 | 10/1984 | Urani | 439/620 |
| 4,486,067 | 12/1984 | Wallner et al. | 439/621 |
| 4,508,412 | 4/1985 | Daggett | 439/621 |
| 4,553,807 | 11/1985 | Cane | 439/272 |

*Primary Examiner*—Gil Weidenfeld
*Assistant Examiner*—Gary F. Paumen
*Attorney, Agent, or Firm*—Russell E. Hattis

[57] ABSTRACT

A fuseholder socket assembly including a side terminal with preferably a pair of helical knob contact finger-engaging surfaces for initially guiding a knob for movement in both axial and circumferential directions toward a locking position where a pair of J-shaped knob contact fingers can interlock with a socket body side terminal with not more than about one-half turn of the knob. The assembly includes a pair of axially inwardly facing abutment shoulders preferably formed by a pair of rigid channel-forming fixed fingers projecting from the side terminal and against which knob contact fingers are urged by a biasing means when the knob is turned into a final locking position and then released. Good electrical contact is preferably achieved by a pair of body side terminal outwardly axially projecting, radially outwardly deflectable resilient contact arms. Each arm has a radially inwardly projecting contact on the inner side thereof positioned to be engaged with a wiping contact by one of the said knob contact fingers when it is rotated into its locking position.

13 Claims, 3 Drawing Sheets

SHOCKPROOF FUSEHOLDER

RELATED APPLICATION

This application is a continuation-in-part of application Ser. No. 926,611, filed Nov. 12, 1986 entitled Shock-Safe Fuseholder Assembly.

TECHNICAL FIELD

The technical field of the invention is the automatic circuit-breaking art, and in particular to holders for electrical fuses.

BACKGROUND OF THE INVENTION

One commonly used form of electrical fuseholder includes a socket body designed to be mounted on a panel so as to accept insertion of fuses from the front of the panel. The fuse is carried and held in place by a knob which fits into an axially extending cylindrical passageway opening onto the front of the socket body. This cylindrical passageway is interrupted by knob or side terminal-receiving orienting slots which interrupt the continuity of the cylindrical surface, making it practically impossible to form a seal between this surface and the knob. Such a seal could be easily effected by a sealing O-ring carried by the outer end portion of the knob if this surface were a continuous one.

Such a knob commonly has a pair of J-shaped bayonet-type contact fingers which interlock with projections on a side terminal in the socket body when the knob is fully inserted and then rotated in a locking direction. In one side terminal design, shown in U.S. Pat. No. 4,072,385 to Wallner, granted Feb. 7, 1978, the side terminal has a circumferentially curving fuse-retaining spring which is axially stressed when the knob is fully inserted. Removal of the knob is achieved by first pressing axially inward on the knob to separate the interlocked parts, rotating the knob in a direction opposite to the locking direction, and then releasing the pressure thereon, whereupon the retaining spring force ejects the knob from the body. Such a fuseholder assembly permits rapid insertion of the fuse-carrying knob as compared with alternative types wherein screw threads are provided on the knob and socket body; however, the fuse-retaining spring can be deformed by constant or careless insertion of the knob.

A fuseholder shown in U.S. Pat. No. 4,477,139 to Urani, issued Oct. 16, 1984 has a socket body side terminal design which is different from that shown in the abovementioned Wallner patent. While the side terminal of the fuseholder shown in the Urani patent does not have a readily deformable fuse-retaining spring as used in the Wallner fuseholder, the side terminals disclosed in this and the Wallner patent, if made to loose tolerances, would not supply a constant pre-loaded electrical contactmaking force against the mating parts of the knob contact fingers and the socket body side terminal, as does the design of the present invention.

A further common problem is also present in a Wallner fuseholder (U.S. Pat. No. 4,072,385) and the Urani fuseholder when the fuseholder knob is of the type having a screwdriver slot-containing head which, when the knob is finally positioned within the socket body, does not project beyond the outer surface of the fuseholder body (or would not do so in the absence of spring pressure). The knob can be removed by inserting a screwdriver into the slot in the knob head and rotating it into its unlocked position only when spring pressure forces the knob outward to a point where it can be grasped and removed from the fuseholder body. It is not an uncommon experience, however, for an operator to extract a suspect fuse, find that it is blown, and place the knob back in the holder temporarily while he goes off to find a replacement fuse. At this point the customary knob spring pressure bearing on the fuse, which normally will eject the knob in the released orientation thereof as described above, is missing. Thus, upon attempting to remove the knob with the spring in this relaxed condition by rotating the knob with a screwdriver, the user finds that the knob remains depressed within the fuseholder body where he cannot grasp it. A sharply pointed knife or the like is then needed to pry or pull the knob out of the fuseholder body.

A similar situation is also encountered in those cases where the retention spring is carried within a conducting sleeve mounted as an extension of the knob assembly, and wherein the fuse end cap accommodated therein has become so corroded so as to freeze to the sleeve. Under such conditions the spring force cannot act against the fuse to assist in the extraction of the knob.

SUMMARY OF THE INVENTION

The preferred form of the present invention provides a socket body side terminal design which can receive the standard-type knob having the bayonet-type J-shaped contact fingers of the Wallner, Urani and other fuseholders. Each J-shaped contact finger has an inwardly axially projecting shank portion from which laterally projects a circumferentially curved free end portion terminating in an outwardly projecting hook-forming projection. The unique socket body side terminal of the invention preferably, but not necessarily, is a cylindrical metal sleeve fitted around an outwardly projecting hollow insulating post forming part of an inner socket body part. This post projects into an outer socket body part in spaced relation to the cylindrical inner passageway thereof, so as to provide clearance for the side terminal sleeve which is mounted upon it. This hollow post insulates the cylindrical sleeve from contact with the inner terminal of a cartridge fuse carried by the knob when the knob is inserted into the socket body passageway.

One of the unique features of this side terminal sleeve is the placement and configuration of outwardly axially extending resilient arms projecting from the outer end of this sleeve. These axially projecting arms have contact-forming protuberances on the inner faces thereof. When the knob assembly is axially inserted to its fullest extent into the socket body passageway, the ends of the J-shaped contact fingers will contact a pair of abutment surfaces and preferably a coil spring in the knob assembly is compressed. As the knob is rotated toward a locking position, the J-shaped contact fingers engage and wipe against these arm contacts, deforming the arms radially outwardly to make a low resistance contact between the contact fingers and the arms, despite loose tolerances of the parts involved. Such rotation is continued until the knob contact fingers strike another pair of abutment shoulders. Release of the knob assembly then causes the assembly to be urged by the coil spring outward where the knob contact fingers strike abutment shoulders of and interlock with portions of the side terminal other than the just described resilient arms thereof. The contact fingers, however, remain in good contact with the contacts of these arms.

Other aspects of the invention to be described relate to the location and construction of rigid channel-forming fingers of the side terminal sleeve which form inner and outer abutment shoulders and fingerreceiving channels engaged by the knob contact fingers in the various positions of the knob assembly during its partial and full insertion into the socket body.

When the knob assembly is turned into its final position and released, the head of the knob assembly may lie recessed within the socket body if it is so designed. As in prior fuseholders, when the knob assembly is to be removed from the socket body, it is pressed axially inwardly and then rotated in a reverse direction from that followed during the insertion of the knob assembly. The resilient force of the compressed coil spring in the knob assembly will then push it outward so it protrudes from the socket body, where the head of the knob assembly can be manually grasped to remove the knob assembly from the socket body.

In case the knob assembly does not carry a fuse which can compress the resilient coil spring within the knob assembly sleeve, the problem remains as to how the knob assembly can be removed from the socket body if the head portion of the knob assembly is recessed within the socket body. In accordance with another feature of the invention, while this problem could be overcome by the specific exemplary means disclosed in the previously mentioned copending application Ser. No. 926,611, it is most advantageously overcome by a pair of helical camming surfaces at the inner end of the side terminal sleeve. The helical camming surfaces are preferably formed by a pair of outwardly extending projections, each of which forms a helical camming surface on one side and an abutment shoulder on the other side which cooperates with the rigid side terminal channel-forming fingers to lock the knob assembly against rotation in its final position in the socket body. The highest points of these helical camming surfaces can be initially engaged by the inner axial ends of the J-shaped fingers of the knob assembly when the knob assembly is pushed axially inwardly. The width of these fingers is such that they will not enter and engage with the side terminal channel-forming rigid fingers until they reach abutment shoulders at the bottom of the helical camming surfaces, where further rotation will bring the knob contact fingers into the channels of the rigid side terminal fingers. If the knob assembly should first strike the outer walls of the rigid side terminal fingers, rotation of the knob assembly in either direction will cause the heel of the knob contact fingers to contact the helical camming surfaces. In so doing, further inward pressure on the knob assembly causes it to rotate in a direction towards a locking position thereof. These helical camming surfaces also act as guides for causing the knob assembly when reversely rotated to move outward from its recessed locked position into a position where the knob assembly projects from the socket body to be grasped by the user for removal therefrom, even in the absence of a fuse in the knob assembly, i.e., where the coil spring would not be compressed to generate a knob assembly ejecting force.

Another feature of the invention is the design of the parts thereof so that the passageway of the socket assembly into which the knob assembly fits can be a continuous cylindrical surface, at least at the entryway portion thereof. In such case, the knob is provided with an O-ring which can seal the knob assembly within the socket body. Fuseholder constructions of the prior art have required that the knob assembly be oriented in one of only two diametrically opposite orientations to allow insertion into the socket body. This is generally achieved by providing the entryway of the socket body passageway with guide channels which would permit the knob assembly to be inserted in only one of these two possible positions. This is not required in the present invention because of the particular construction of the side terminal sleeve arms, fingers, and cam-forming projections as previously described, which permits knob assembly insertion at any insertion orientation. To eliminate the use of similar channels for receiving and orienting the side terminal during the assembly of the fuseholder, the socket body is made of two separate parts, an outer socket body part and an inner socket body part. The side terminal sleeve is preferably initially mounted over the aforementioned insulating post projecting from the outer end of the inner socket body part. This sub-assembly is then inserted into guide channels in the inner end of the outer socket body part. The two socket body parts are then ultrasonically welded together.

The above and other features of the invention will become apparent upon making reference to the specification and claims to follow and the drawings.

DESCRIPTION OF THE INVENTION

Figures 1, 2, 6:
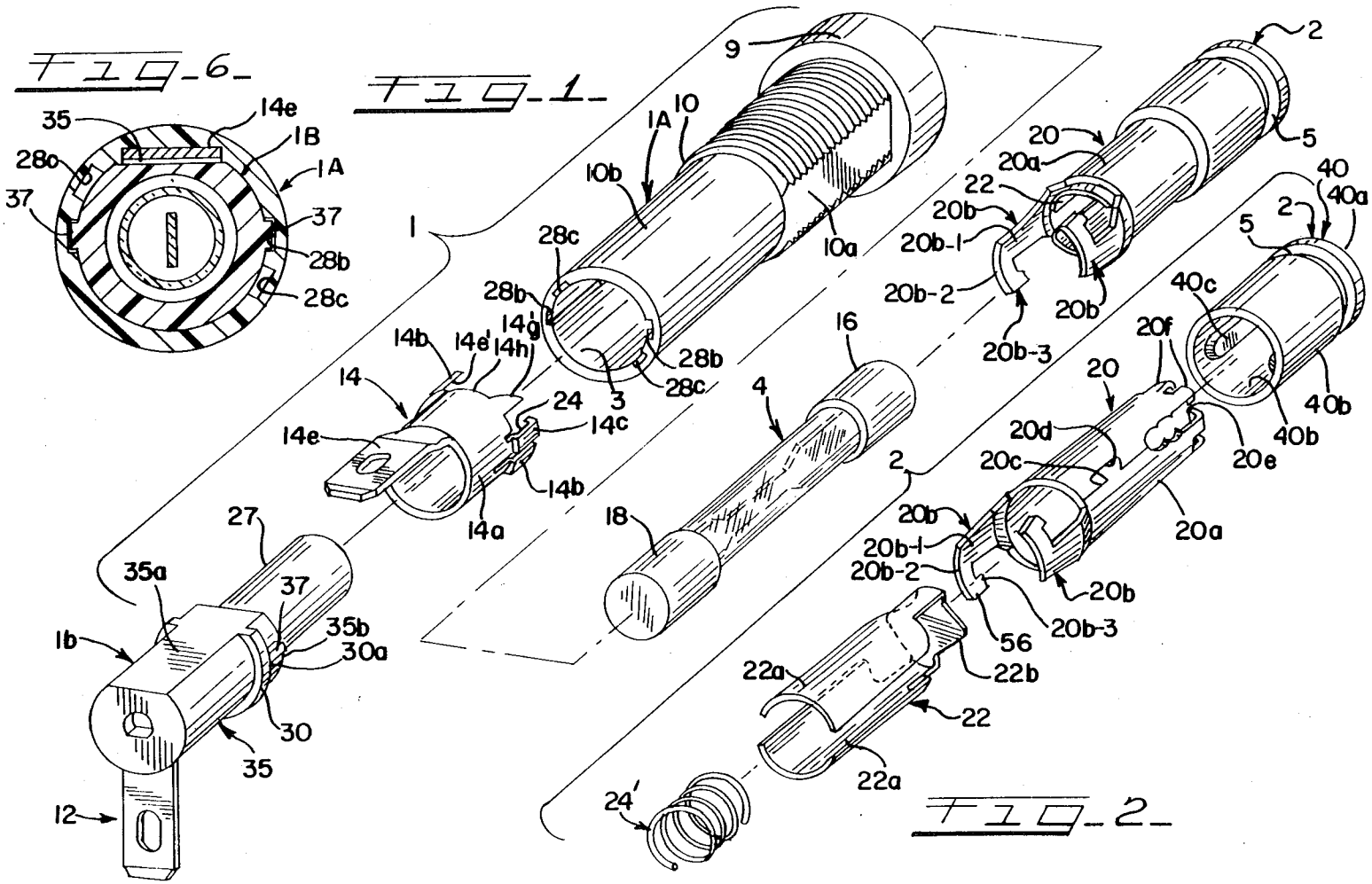
FIG. 1 is an exploded perspective view of the socket body parts, the cartridge fuse and the knob assembly which form a subassembly insertable as a unit into the entry opening of the socket body assembly.
FIG. 2 is an exploded perspective view of the different parts making up the knob assembly shown in assembled form in FIG. 1.
FIG. 6 is a transverse sectional view taken through the assembly of FIG. 3A, taken in a section plane 6—6 which shows the interlocking of the socket body parts to the side terminal sleeve.
Figure 3A:
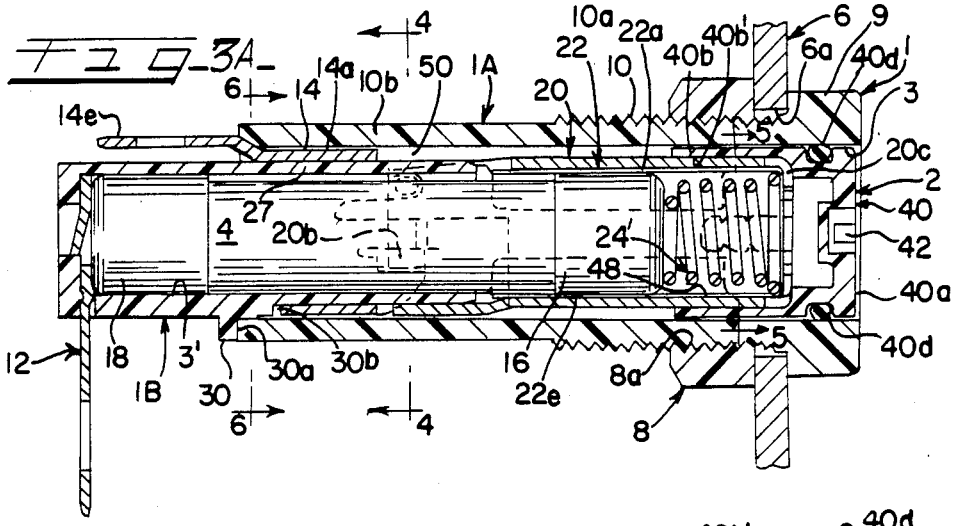
FIG. 3A is a longitudinal sectional view through the assembly of parts shown in FIG. 1, when that assembly is mounted with an affixed O-ring in an opening in a panel.
Figure 3B:
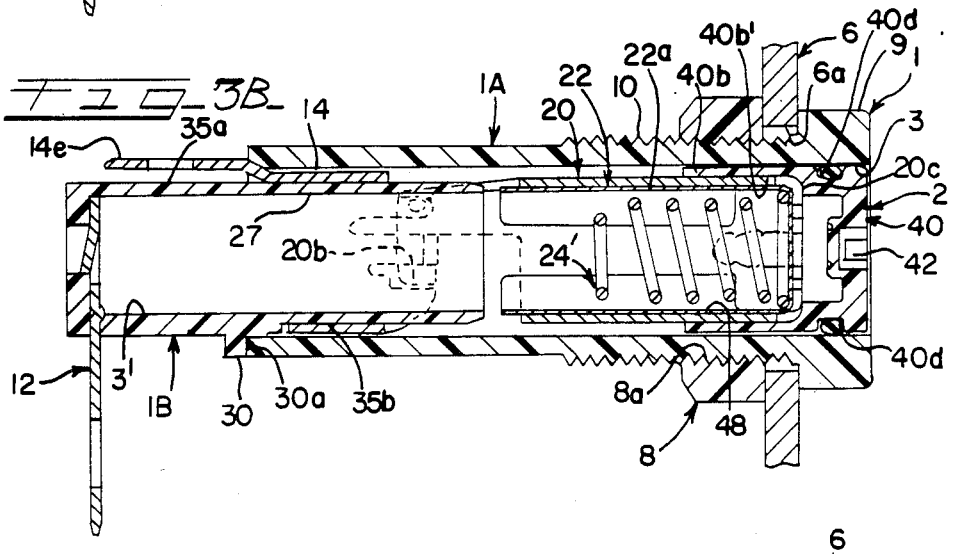
FIG. 3B is a view corresponding to FIG. 1 where the cartridge fuse shown in FIG. 3A has been removed for fuse replacement, and the knob assembly is mounted in its normal seated position recessed within the socket assembly.

Referring now more particularly to FIGS. 1 and 3A, the fuseholder there shown comprises a socket assembly 1 within which is removably mounted a knob assembly 2 carrying a cartridge fuse 4. The fuse 4 is gripped within the knob assembly 2 in a manner to be described. The fuse 4 projects axially inwardly from the knob assembly 2 when it is inserted into the entryway of a cylindrical axial passageway 3 formed in the socket assembly 1. Unlike prior art fuseholders where the knob assembly must have a fixed predetermined orientation with respect to the socket assembly when inserted therein, requiring guiding slots in the entryway of the socket body passageway, the knob assembly 2 can have any orientation for its proper insertion. The socket body passageway 3 for most of its length is defined by a continuous cylindrical surface, against which seals the compressed periphery of an O-ring **40*d* annularly mounted in a groove 5 on the outer end of the knob assembly 2**.

Because of the unique construction of the fuseholder of the invention, the mounting procedure for the knob assembly 2 is to first fully insert the knob assembly into the socket assembly 1, whereupon the knob assembly will strike stop shoulders to be described. Upon rotation in either direction while exerting a slight inward pressure to the knob assembly by a screwdriver applied to a slot 42 in the outer face of the knob assembly 2, the knob assembly will automatically be guided against camming surfaces which, in turn, rotate the knob assembly into a locking position defined by rotation stop shoulders. Upon release of the knob assembly 2, the pressure from a compressed coil spring 24' in the knob assembly will automatically move the knob assembly slightly outwardly to a point where the knob assembly will be in a final locked, low contact resistance position.

Figure 3C:
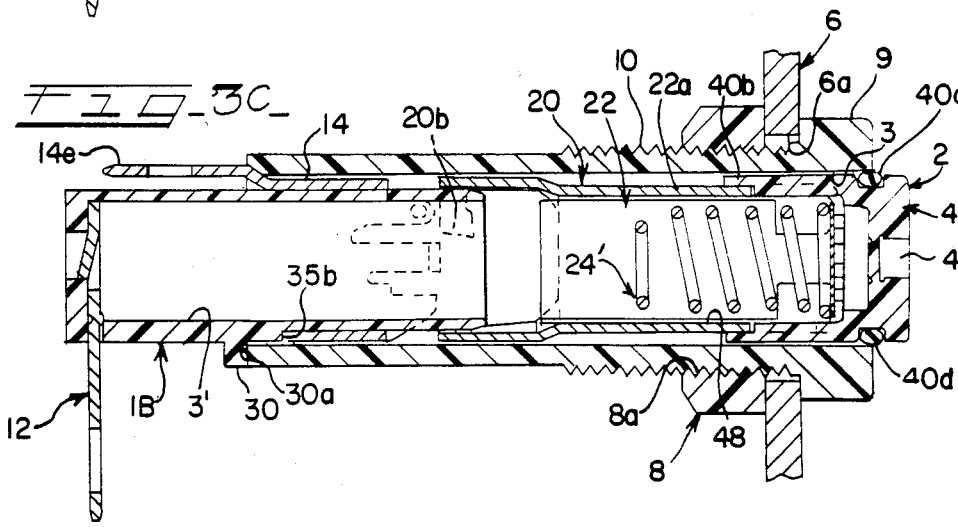
FIG. 3C is a view corresponding to FIG. 3B where the knob assembly has been rotated a fraction of a turn from the position shown in FIG. 3B where, because of one of the features of the invention, the front end of the knob assembly projects from the socket assembly so that it can be grasped for removal therefrom.

As shown in FIG. 3A, in the final locked position of the knob assembly 2, the outer face of the knob assembly is slightly recessed within the socket assembly 1. As long as the fuse 4 is in the knob assembly 2, the coil spring 24' will exert a pressure which will eject the knob assembly from the socket assembly 1 upon reverse rotation of the knob assembly. However, when the fuse 4 is removed from the knob assembly 2, as shown in FIG. 3C, in accordance with another feature of the invention, the reverse rotation imparted to the recessed knob assembly will still cause ejection of the knob assembly, so that it can be manually grasped for removal.

In FIGS. 3A throuqh 3C, the fuseholder of the invention is shown mounted in an opening **6*a* in a vertical mounting panel 6. The opening 6*a* will have a contour with a flat on one side of the shank portion thereof so as to receive a correspondingly flat shank portion 10*a* of an outer knob body part 1A to be described. The shank portion has screw threads 10 for receiving a securing nut 8 having an internal thread 8*a* (FIG. 3A) which threads upon the threads 10 of the outer socket body part 1A of the socket assembly 1. The nut 8 bears against the rear face of the panel 6 to draw a flanged head portion 9 of the outer socket body part 1A against the panel 6**.

As previously indicated, another feature of the invention deals with the unique design of a socket body assembly side terminal 14 to be described which ensures a constant pre-loaded wiping force against the mating parts of the side terminal and the J-shaped contact fingers **20*b*-20*b* projecting axially from the inner end of the knob assembly 2**.

Now that the basic advantageous features of the fuseholder of the invention have been described, the details of the preferred details of the parts which achieve the advantageous results referred to will now be described.

In the present invention, the side terminal 14 is mountable within the socket body from an inner end of one of the socket body parts so that the continuity of the entryway end of the cylindrical surface of the socket body passageway 3 is not interrupted. This is made possible by the unique construction of the socket body assembly 1 initially in two separate parts, namely the outer socket body part 1A and an inner socket body part 1B made of a suitable insulating material.

Figure 7A:
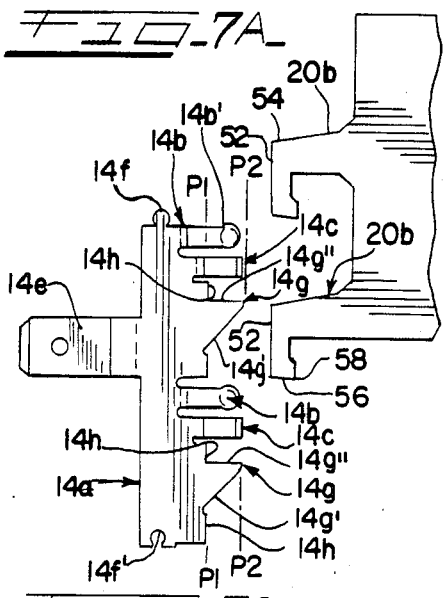
FIGS. 7A, 7B, 7C, 7D, and 7E, respectively illustrate five different positions which the knob assembly has relative various arm, projections, and fingers of the unique socket body side terminal of the invention as the knob assembly is progressively moved into the socket assembly. (For ease of drawing, the parts involved are shown in flattened form.)

The side terminal 14, which is an initially formed as a flat stamped metal plate, as best shown in FIGS. 7A through 7E, is formed into a cylindrical shape and interlocked by means of a projecting tab **14*f* fitting into a correspondingly shaped slot 14*f'*. The terminal 14 has a main sleeve-forming body portion 14*a* (see also FIG. 1) having a diameter slightly less than the diameter of the cylindrical passageway 3, as best shown in FIG. 3A. Axially projecting inwardly from the inner or rear end of the sleeve portion 14*a* is a terminal tab 14*e* which lies in a plane beyond the periphery of the cylindrical sleeve portion 14*a*. Projecting from the front or outer end of the sleeve portion 14*a* at diametrically opposite sides thereof are a pair of outwardly axially extending resilient contact arms 14*b*-14*b*. Projecting inwardly from the radially inwardly facing surfaces of these arms are dimple contacts 14*b'*-14*b'* (FIG. 7A). These arms 14*b*-14*b* are formed as cylindrical segments and are located outboard of the periphery of the sleeve portion 14*a* and fit within slots 28*c*-28*c* formed in the defining walls of the inner or rear end of the portion of the cylindrical passageway 3 in the outer socket body part 1A. (The rear end portion 3' of the cylindrical passageway 3 is in the inner socket body part 1B.) Spaced a short distance in the same direction from the resilient arms 14*b*-14*b* and extending generally parallel thereto are relatively rigid channel-forming fingers 14*c*-14*c*. These fingers define circumferential inwardly radially opening channels 24-24 (see FIGS. 1 and 7C). These channels are defined by an inner abutment shoulder 24*a* and an outer abutment shoulder 24*d*. The relatively rigid side terminal fingers 14*c*-14*c* fit within correspondingly located slots 28*b*-28*b* formed in the defining walls of the inner or rear end of the cylindrical passageway 3 in the outer socket body part 1A**.

The outer or front end of the sleeve portion **14*a* is provided with abutment shoulders 14*h*-14*h* at points contiguous to the lower or inner ends of outwardly inclining cam surfaces 14*g'*-14*g'* formed on one side of camforming projections 14*g*-14*g*. The steep sides of these projections form side abutment shoulders or stops 14*g''*-14*g''*. These cam surfaces 14*g'*-14*g'* form helical surfaces when the flat stamped side terminal part shown in FIG. 7A is formed into a cylindrical piece. The highest points of the cam surfaces 14*g'*-14*g'* are in the same transverse plane P2 as the flat outer abutment shoulders 24*b*-24*b* of the side terminal rigid fingers 14*c*-14*c*. The projections 14*g*-14*g* form an extension of the sleeve portions 14*a* so as to closely fit the defining walls of the cylindrical passageway 3 in the outer socket body part 1A**.

The inner socket body part 1B has a hollow cylindrical base portion 35 (FIG. 1) with a flat **35*a* extending the full axial length thereof. A flange 30 projects therefrom to form a first annular axially facing abutment shoulder 30***a*. The outer end face of the base portion 35 forms a second annular axially facing abutment shoulder 35*b*. Projecting outwardly from shoulder 35 is a reduced cylindrical hollow post 27 which projects into and makes a sliding fit within the interior of the cylindrical sleeve portion 14*a* of the side terminal 14. The hollow post 27 prevents the side terminal 14 from being contacted by the inner end terminal 18 of the fuse 4 during the insertion of the knob assembly 2 into the socket assembly passageway 3. The rear or inner end of the sleeve portion of the side terminal 14*a* abuts the annular shoulder 35*b*, and the hollow post 27 with the side terminal 14 mounted thereon fits in the cylindrical passageway 3 in the outer body part 1A, as best shown in FIGS. 3A and 6. The inner body part 1B can have only one orientation with respect to the side terminal 14 due to the flat 35*a* thereon which permits the terminal tab 14*e* of the side terminal to pass over the base portion 35 of the inner socket body part 1B. Also, positioning ribs 37-37 project forwardly from the annular shoulder 35*b* on opposite sides of the flat 35*a*. The ribs 37-37 are adapted to slide within the same positioning slots 28*b*-28*b* of the outer socket body part 1A which receive the sleeve fingers 14*c*-14*c*, as shown in FIG. 6.

Initially, as shown in FIG. 1 the sleeve 14 is positioned over the hollow post 27 of the inner socket body part 1B and the resulting assembly is then inserted with the proper orientation into the rear or inner end of the outer socket body part 1A. When the inner body part is fully inserted within the outer socket body part, the inner face of the outer socket body part abuts the shoulder 30*a* on the outer side of the flange 30 of the socket body part 1A, and the two parts are then ultrasonically welded along the interfaces between the flange 30 and the inner edge of the outer socket body part 1A.

Refer now to FIGS. 2 and 3A where the details of the knob assembly 2 are best shown. As there shown, the knob assembly comprises an insulating knob part 40, a fuse-receiving sleeve 20 from which the knob contact fingers 20*b*-20*b* extend, a contact clip 22 and the coil spring 24. The insulating knob part 40 has a head portion 40*a* with a screwdriver slot 42. A skirt 40*b* extends from the head portion 40*a* and is of slightly smaller diameter than the passageway 3. The knob skirt 40*b* has an annular groove 5 into which is mounted a resilient O-ring 40*d* which projects from the skirt 40*b* and thereby seals against the defining walls of the passageway 3. The skirt 40*b* has an interior passageway 40*b*' into which is tightly fitted the fuse-receiving sleeve 20. The sleeve 20 is an initially flat-stamped metal plate, the sleeve-forming portion 20*a* of which is bent into a cylindrical shape and interlocked by a locking tab 20*c* fitting into a slot 20*d*. A pair of jagged ribreceiving slots 20*e*-20*e* lockingly receive a rib 40*c* projecting from the interior 40*b*'-40*b*' of the knob skirt 40*b*. The sleeve portion 20*a* has spaced internal teeth 20*f* at its outer end. The sleeve 20 frictionally fits within the cylindrical interior of the skirt 40*b*. Located within the sleeve 20 is a contact clip 22. The contact clip has a pair of confronting arms 22*a*-22*a* between which the outer terminal 16 of the fuse 4 can be wedged to separate these arms to apply a gripping force around the body of the fuse. The outer end of the contact clip has projecting ears 22*b* (FIG. 2) which are force fitted within the front end of the sleeve portion 20*a* to underlie the end of the sleeve 20 between the spaced teeth 20*f*.

The cartridge fuse 4 has an outer end terminal 16 gripped by the contact clip arms 22*a*-22*a* and abutting the end of the coil spring 24 friction fitted within the contact clip 22. The inner socket body part 1B has a lateral projecting terminal 12 lock-fitted in the end of the inner socket body part. It is exposed in the cylindrical passageway 3 of this part to be contacted by the inner end terminal 18 of the fuse 4. Shortly before the knob assembly reaches its innermost position within the socket body part 1B, the fuse terminal 18 will strike the end terminal 12 to cause the coil spring 24' within the knob assembly to be compressed. This then exerts an outward force on the knob assembly which becomes effective upon release of inward pressure on the knob assembly by the user.

Projecting axially inwardly from the rear or inner end of the knob sleeve 20 are the previously mentioned J-shaped contact fingers 20*b*-20*b*. Each of these contact fingers has an axially extending portion 20*b*-1 which projects beyond the periphery of the cylindrical outer surface of the sleeve portion 20*a*. Each finger further has at its inner ends a circumferentially curving portion 20*b*-2 which fits within the annular cylindrically shaped space 50 (FIG. 3A) between the hollow insulating post 27 and the shank portion 10*b* of the outer socket body part 1A. Each circumferentially curving finger portion 20*b*-2 terminates in an outward projecting hook-forming projection 20*b*-3.

Reference should now be made to FIGS. 7A through 7E for an understanding of the manner in which the J-shaped fingers 20*b*-20*b* interact with the various axially extending projections of the side terminal 14.

The rear or inner ends of the contact fingers 20*b*-20*b* have flat surfaces 52-52,lying in a plane at right angles to the axis of the fuseholder. The free end 56 of the circumferentially curving portion 20*b*-2 of each finger 20*b* is shown as an inclined surface terminating in an outermost point 58. The distance between this point 58 and the knee or inner end 54 of each finger end surface 52 is identified as a dimension D1 in FIG. 7C. FIG. 7A shows a plane P1 transverse to the fuseholder axis passing through the outermost or high points of the side terminal cam surfaces 14*g*'-14*g*' and the outer abutment shoulders 24*b*-24*b* of the rigid side terminal fingers 14*c*-14*c*. The abutment shoulders 14*h*-14*h* on the forward ends of the sleeve portion 14*a* of the side terminal 14 are in a plane P1 parallel to the plane P2, and are located adjacent to the innermost ends of the helical cam surfaces 14*g*'-14*g*'. This plane P1 intersects each surface 14*g*' at a point spaced a distance D2 (FIG. 7C) from the side surfaces of the nearest locking finger 14*c*. The distance D2 should be no less than the dimension D1 of the knob contact fingers 20*b*-20*b*, so that when these fingers reach the abutment shoulders 14*h*-14*h* the free ends of the fingers can enter the channels 24-24 of the rigid side terminal fingers 14*c*-14*c*.

Figure 7B:
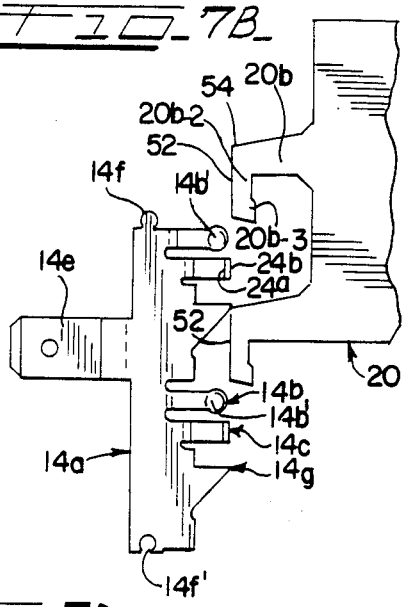
Figure 7C:
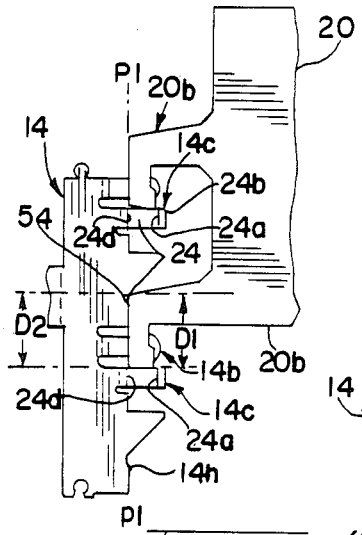
Figure 7D:
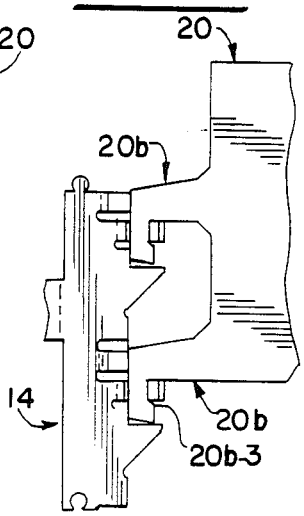
Figure 7E:
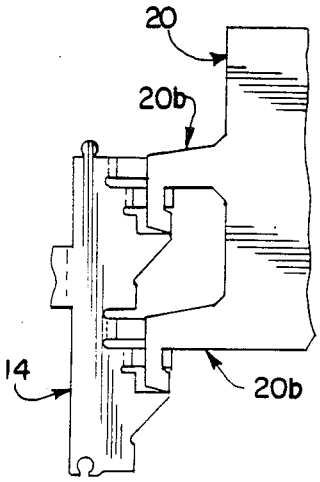
Figure 4:
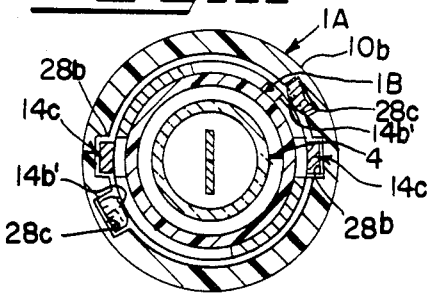
FIG. 4 is a transverse sectional view through the assembly shown in FIG. 3A, taken in section plane 4—4 which shows the interlocking of the socket body side terminal and knob assembly parts.
Figure 5:
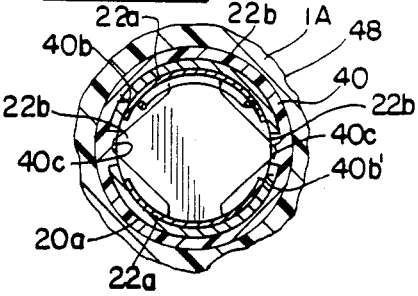
FIG. 5 is a transverse sectional view through the assembly shown in FIG. 2, taken in section plane 5—5 which shows the relationship of the different parts making up the knob assembly.

Accordingly, in all possible orientations of the knob assembly, the flat end surfaces 52-52 of the fingers 20*b*-20*b* will either strike the peaks of the cam-forming projections 14*g*-14*g* and the outer abutment shoulders 24*b*-24*b* of the rigid side terminal fingers 14*c*-14*c*, or alternatively some point along the cam surfaces 14*g*'-14*g*'. If these knob fingers first strike the abutment shoulders 24*b*-24*b*, and the knob assembly is rotated in either direction from this position as it is pressed axially inwardly, the heel end 54 of the inner surfaces 52 of each contact finger 20*b* will strike a cam surface 14*g*' of one of the side terminal projections 14*g*-14*g* (FIG. 7B).

The continued inner axial force on the knob assembly will then, under the action of the cam surfaces 14g'-14g' cause the fuse knob assembly to rotate in a direction to move the contact fingers 20b-20b toward and into engagement with the nearest side terminal contact arms 14b-14b. These contact fingers will preferably engage with the contact projections of the side terminal arms 14b-14b before the flat ends 52-52 of the knob contact fingers 20b-20b reach the abutment shoulders 14h-14h at the bottom of the cam surfaces 14g'-14g'. The inner end terminal 18 of the fuse 4 will then have reached the inner most terminal 12 exposed at the bottom of the knob assembly passageway 3' formed by the inner socket body part 1B. The further inward axial movement of the knob assembly from the point where the inner fuse terminal 18 first makes contact with the terminal 12 of the inner socket body part 1B will cause the coil spring 24 to become progressively compressed.

When the end surfaces 52 of the contact fingers 20b-20b reach the bottom of these camming surfaces 14h-14h (FIG. 7C), these end surfaces are at a point adjacent the entryway of the channels 24-24 of the side rigid terminal fingers 14c-14c. Further rotation of the knob assembly in this same direction will bring the ends of the fingers 20b-20b against the abutment shoulders 14g''-14g'' on the steep sides of the cam-forming projections 14g-14g (see FIG. 7D). The release of axial pressure on the knob assembly will then cause the knob assembly and their fingers 20b-20b to move forwardly where the circumferentially curving portions 20b-2 will engage the outer abutment shoulders 24a-24a of the rigid side terminal fingers 14c-14c (see FIG. 7E). The hook-forming projections 20b-3 of the fingers 20b-20b will then be closely engaged between the abutment shoulders 14g''-14g'' of the side terminal projections 14g-14g and the nearest side margins of the rigid side terminal fingers 14c-14c.

To remove the knob assembly from the socket assembly, it is pressed in and rotated in the opposite direction from that just described. The heel ends 54-54 of the outer surfaces 52-52 of the contact finger 20b-20b will then ride up the helical surfaces 14g-14g of the associated cam-forming projections 14g'-14g' even if there is no fuse in the knob assembly to compress the coil spring 24'. The knob assembly then will be progressively guided outwardly to an outermost position where the knob assembly projects beyond the socket assembly where it can be manually grasped for removal from the socket assembly.

It is apparent that the present invention is a very reliable fuseholder assembly which features a constant contact wiping action at all times between the knob contact fingers 20b-20b and the contact protuberances 14b'-14b' of the axially extending arms 14b-14b of the side terminal 14. Additionally, there is a water-tight seal provided between the knob assembly and the socket assembly due to the O-ring 40d. Finally, even when the fuse 4 is removed from the knob assembly, the knob assembly can readily be removed from the socket assembly without any special tools.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention, in appropriate instances even the specific claims involved should be construed in light of the doctrine of equivalents.

I claim:

1. In a fuseholder socket assembly including a socket body made of insulating material and having a fuse-receiving passageway extending axially inwardly from an outer face thereof for receiving a cartridge-type electrical fuse, said socket body including an innermost terminal in said passageway to be engaged by the innermost terminal of the cartridge fuse supported by and inwardly axially projecting from a knob which in its final position can lie recessed within the socket body, and a stationary side terminal in said passageway positioned to make electrical contact with at least a first axially extending knob contact finger which is disposed to be electrically connected in said knob to the outermost terminal on said cartridge fuse, and resilient biasing means for exerting an outwardly axially directed ejecting force on said knob as a result of a fuse inserted in said knob which strains the biasing means, the improvement wherein:

said side terminal has at least a first stationary helical camming surface portion disposed to be contacted by the inner end of a knob contact finger upon insertion of said knob, said first helical portion adapted to initially guide said knob for movement in both axial and circumferential directions toward a locking position where said contact finger can interlock with said side terminal with not more than substantially one-half turn of the knob, and an axially inwardly facing abutment shoulder for each knob contact finger and against which the associated contact finger is urged by said biasing means when knob is turned in said circumferential direction into a final locking position, said first helical portion of said side terminal being disposed to be traversed by said first contact finger when the knob is rotated from its locking position so as to eject said knob from said passageway even when a fuse is removed from the body and the biasing mean is unable to eject the knob.

2. The fuseholder socket assembly of claim 1 wherein said side terminal has a second helical contact finger-engaging portion substantially identical to said first helical portion and disposed on the opposite side of said socket body for receiving the inner end of a second knob contact finger substantially identical to said first knob contact finger and located on the opposite side of said knob, said socket assembly having a second axially inwardly facing abutment shoulder for said second knob contact finger and against which the associated second contact finger is urged by said biasing means when the knob is turned in a circumferential direction into a final locking position, said assembly including said second knob contact finger.

3. The fuseholder socket assembly of claims 1 or 2 wherein said socket body side terminal has for engaging each of said knob contact fingers an outwardly axially projecting radially outwardly deflectable resilient contact arm, each arm having a radially inwardly protruding contact on the inner side thereof positioned to be engaged with a wiping contact by one of said knob contact fingers when it is rotated into said locking position and configured to make continuing contact therewith when said biasing means has urged said knob into its final position against a respective said abutment shoulder.

4. The fuseholder socket body of claims 1 or 2, wherein each of said side terminal helical portions forms one side of an outwardly axially-extending projection, the opposite sides of which form abutment shoulders disposed to terminate rotation of said knob when turned in said circumferential direction.

5. The fuseholder socket body assembly of claim 1 wherein said abutment shoulder is formed by the radially inwardly bent end of a finger extending axially outwardly from an outer end surface of said side terminal.

6. The fuseholder socket assembly of claim 1 wherein said inwardly facing abutment shoulder is at the end of a finger.

7. In a fuseholder socket body assembly including a socket body made of insulating material and having a fuse-receiving passageway extending axially inwardly from an outer face thereof for receiving a cartridge-type electrical fuse, said socket body including an innermost terminal in said passageway disposed to be engaged by the innermost terminal of a cartridge fuse supported by and axially inwardly projecting from a knob, and a side terminal in said passageway positioned to make electrical contact with at least a first axially extending, J-shaped knob contact finger in such knob disposed for connection to the outermost terminal on said cartridge fuse, resilient biasing means for exerting an outwardly axially directed ejecting force on said knob as a result of a fuse inserted in said knob which strains the biasing means, and an axially inwardly facing abutment shoulder for each said knob contact finger and against which the associated contact finger is urged by said biasing means with the knob turned in a circumferential direction into a final locking position, the improvement wherein:

said socket body side terminal has for engaging each of said knob contact fingers an axially extending radially outwardly deflectable resilient cantilevered contact arm, each said contact arm having a radially inwardly protruding contact on the radially inwardly facing side thereof positioned to be engaged and be radially deflected outwardly with a wiping contact by one of said knob contact fingers when the knob is rotated into a locking position and continuing to make contact therewith when said biasing means has urged said knob into its final position, said abutment shoulder not being located on said contact arms.

8. The fuseholder socket assembly of claims 1, or 2 wherein each abutment shoulder is part of said socket body side terminal.

9. The fuseholder socket assembly of claims 1, 7, or 2 wherein each abutment shoulder is part of said socket body side terminal, and each abutment shoulder is formed by an inwardly axially facing channel-forming rigid finger projecting axially outwardly from the outer end of said side terminal providing each such side terminal finger a laterally opening channel, into which the associated knob contact finger passes when it is moved to its locking position, each knob contact finger having a hook-forming projection on the end thereof which hooks around the side of said rigid side terminal finger when the knob is turned to locking position and manual pressure on said knob is released.

10. The fuseholder socket assembly of claims 1 or 7 wherein said socket side terminal includes a cylindrical sleeve portion which passes over a hollow insulating post forming part of said socket body and which prevents the inner end terminal of said cartridge fuse from engaging said side terminal when the knob is inserted into the socket body, and each of said helical portions is an axially outwardly projecting portion on the outer end of said sleeve portion.

11. The fuseholder socket assembly of claims 1, 7, or 2 wherein said socket body comprises an outer socket body part with part of said passageway axially passing therethrough, said socket body side terminal being insertable into said socket body passageway from the inner end of said outer socket body part, said socket body having an inner socket body part having an axial passageway to form a continuation of said passageway in said outer socket body part with said innermost socket body terminal disposed to be exposed therein, the outer end of said inner socket body part having a hollow post with said side terminal is mounted thereon and which together with said side terminal is inserted into said outer socket body part, the inner and outer socket body parts being secured together after such assembly, the entryway portion of said socket body passageway being a substantially completely cylindrical portion against which an O-ring carried on said knob can make a sealing engagement when the knob is fully inserted into the socket body.

12. The fuseholder socket assembly of claim 11 combined with said knob with said O-ring carried thereon.

13. The fuseholder socket assembly of claim 1 or 7 combined with said knob.

* * * * *